US011380185B2

(12) United States Patent
Truchsess et al.

(10) Patent No.: US 11,380,185 B2
(45) Date of Patent: Jul. 5, 2022

(54) RETAIL INTERNET OF THINGS (IOT) PLATFORM WITH IN-STORE CONTACTLESS CALL BUTTON

(71) Applicant: FlorLink, Inc., Newport, RI (US)

(72) Inventors: Julia Truchsess, Sandy Hook, CT (US); Bill Dussinger, Cumberland, RI (US); Mark Barnes, Newport, RI (US)

(73) Assignee: FLORLINK INC., Newport, RI (US)

( * ) Notice: Subject to any disclaimer, the term of this patent is extended or adjusted under 35 U.S.C. 154(b) by 0 days.

(21) Appl. No.: 17/333,196

(22) Filed: May 28, 2021

(65) Prior Publication Data

US 2021/0375116 A1 Dec. 2, 2021

Related U.S. Application Data

(60) Provisional application No. 63/031,826, filed on May 29, 2020.

(51) Int. Cl.

| | |
|---|---|
| ***G08B 21/18*** | (2006.01) |
| ***G16Y 40/60*** | (2020.01) |
| ***G16Y 10/45*** | (2020.01) |

(52) U.S. Cl.

CPC ..... *G08B 21/182* (2013.01); *G16Y 10/45* (2020.01); *G16Y 40/60* (2020.01)

(58) Field of Classification Search

CPC ..... G08B 21/182; G08B 25/12; G08B 21/22; G16Y 10/45; G16Y 40/60

See application file for complete search history.

(56) References Cited

FOREIGN PATENT DOCUMENTS

| | | | | |
|---|---|---|---|---|
| JP | 2005263378 | * | 9/2005 | |
| JP | 6971420 B1 | * | 11/2021 | |
| KR | 100858892 | * | 9/2008 | ..... E05B 17/22 |

* cited by examiner

*Primary Examiner* — Hongmin Fan

(74) *Attorney, Agent, or Firm* — Lathrop GPM LLP; Wm. Tucker Griffith

(57) ABSTRACT

The present invention describes a contactless signaling system for retail and other commercial environments whereby customers or workers can submit requests for assistance without the need to physically touch any button or other input device. A contactless call button unit comprises a proximity sensor operatively communicating with transmission means for sending a signal to at least one of a hub appliance and an employee communication receiver. The proximity sensor is triggered without requiring the user to physically contact the call button unit. Instead, when a portion of the user's body, such as the user's hand or finger, is within a predefined distance from the call button unit for a predefined period of time, a signal will be transmitted with a call request message.

20 Claims, 6 Drawing Sheets

RETAIL INTERNET OF THINGS (IOT) PLATFORM WITH IN-STORE CONTACTLESS CALL BUTTON

CROSS-REFERENCE TO RELATED APPLICATION

This application claims the benefit of U.S. Provisional Application Ser. No. 63/031,826, filed May 29, 2020, which is incorporated herein by reference in its entirety.

FIELD OF THE INVENTION

The present invention generally relates to the fields of retail IoT platforms and commercial signaling systems for such platforms, commonly known as "Call Buttons," and more particularly to contactless signaling systems for use with retail IoT platforms designed to provide alerts and/or summon assistance to a specific location at the request of a shopper or worker.

BACKGROUND OF THE INVENTION

In the retail environment, Internet of Things (IoT) systems are known and commonly used to interconnect various systems, devices and components of a retail store with an aim towards improving operations and efficiency. In general, such systems connect a sales floor environment, both actual and virtual, with a backroom environment (covering management, accounting, distribution, store room, and the like). Of great importance in the use of retail IoT platforms, is the use of signaling systems to provide alerts from customers or workers in one part of the store (e.g., the sales floor) to other parts of the store (e.g., the store room) or to other workers to request assistance. A general schematic illustrating the interconnectivity of a retail IoT platform is illustrated in FIG. 1.

As illustrated, the main "appliance" in a retail IoT system comprises a centralized operational hub that is generally connected via wired or wireless connections with other operations systems, device and components that are useful, and often critical, for day-to-day operation of the store. As shown in FIG. 1, a hub appliance 10 can receive incoming alerts from a number of input sources, such as cameras and motion detectors 12, call buttons 14, customers' smart phones and personal devices 16, an online ordering system 18, Bluetooth beacons 20, such as sensor mats, and the like. Similarly, the hub appliance 10 can be in outgoing operative communication with a number of output devices, such as communication devices 22 (e.g., walkie talkies, pagers, receivers, worker phones or communication devices), digital signage 24, printers or cash registers 26, check-out and point-of-sale (POS) systems and kiosks 28, workers' phones, tablets, email and text systems 30, and the like. Still further, the hub appliance 10 can be in operative communication with a remote cloud support system 32 or other systems covering accounting, inventory, distribution, and logistic operations, including remote systems in a different physical and geographical location.

In a typical retail store set-up, there are often several customer call buttons that communicate with the hub appliance. Call buttons are familiar to shoppers everywhere. Retailers commonly reduce operating costs by placing call buttons at locations customers are likely to need assistance, rather than maintaining staffing levels such that all such locations are monitored by humans. Such call buttons help customers to provide alerts to store employees when assistance is needed. Additionally, call buttons can provide workers with information of in which portions of the store customers are located. Still further, such call buttons can provide awareness to employees that customers may need assistance and can work to improve customer engagement to increase sales. Call buttons can also be used by workers to communicate with other workers—for example, checking with a store room about inventory in stock or requesting additional assistance.

Call buttons are also found in industrial, office, warehouse or factory settings, for summoning assistance or initiating alarm conditions in the event of safety or security hazards, for example.

Further, call buttons and similar signaling systems can provide added benefits to a retail store environment. For example, call button set-ups can include means for aural and/or visual interaction between customers and workers—for example, via an intercom or digital display set-up. Further, customer use of a call button can activate a corresponding video camera to assist interaction with the customer.

Today, all call buttons either have a manual button (actuator) that one must physically press and release or a capacitive touch button, where a user must still touch the overlay of the call button to trigger transmission of a message to the hub appliance. For such call buttons to be useful, they generally must connect, either with wires or wirelessly, to an annunciator of some kind, providing a visible or audible alert or message to appropriate personnel. The simplest embodiment is a two-node system, similar to a common doorbell. Most commercial installations, however, incorporate a central "communications hub," as discussed above, which receives signals from distributed call buttons (and often other devices such as cameras, door sensors, occupancy sensors, etc., as illustrated in FIG. 1) and which, on receipt of an incoming signal, transmits appropriate messages to appropriate personnel to initiate the desired response. The transmissions from the hub appliance may take the form of public-address system announcements, radio transmissions to portable receivers carried or worn by store personnel, lighted indicators at specific locations, or any such broadcast or narrowcast methods of dissemination.

Various drawbacks of prior art call buttons used in the retail environment have been identified. For example, a big concern for existing call button designs is that such call buttons that must be physically touched to initiate an alert message or request for assistance. As a result, such existing call button designs carry the risk of disease transmission by being touched by multiple persons. In present time, there are increased risks associated with disease and virus transmission both from person to person interaction, but also based on surface contact transmission. Indeed, a worldwide effort to promote social distancing has recently been established, especially in retail environments, such that physical contact is minimized.

Manual call button or capacitance touch button are also susceptible to wearing down and even breaking due to repeated use and contact, especially if the customer presses too hard on the button to initiate a call response.

Additionally, prior art call buttons may also include store phones, intercoms or digital displays/inputs that allow customers to communicate with store employees. Like the call buttons themselves, however, such added components also require physical touching of the components In view of the foregoing, there is a need for a customer signaling system for use in the retail IoT platform that is touch-free or contactless, such that an individual can provide an alert or request for assistance in a retail environment without needing to physically touch a call button or other in-store signaling device that may not be clean. Additionally, there is a need for a call button design that can improve interaction between individuals that may not require direct physical interaction, while also not requiring an individual to physically touch anything (such as a call button or intercom) in order to request assistance. Accordingly, it is a general object of the present invention to provide a customer signaling system for use in a retail IoT platform that improves upon conventional call buttons currently used in the marketplace and that overcomes the problems and drawbacks associated with such prior art call buttons.

SUMMARY OF THE INVENTION

In accordance with the present invention, a retail IoT platform using a contactless or touchless call button is provided. Given recent concerns over public transmission of diseases and viruses, and newly enacted strategies to ensure proper social distancing in public spaces, a "touchless" or "contactless" call button is advantageous in the retail environment so that customers do not need to touch communal surfaces and risk contracting or spreading germs or virus. Instead, in accordance with the present invention, a "touchless" call button only requires users to place their hand or finger within a predefined distance (e.g., about an inch) of the call button unit and it will trigger an alert message or request for assistance. This enhances customer service by providing a safe tool for customers to request immediate assistance when ready to interact with a store associate, either in person or using means to permit such interaction, such as, an intercom, an audio/visual display, or via digital means. Additionally, such a system allows store personnel to do other tasks and respond timely and appropriately when a customer needs assistance. Still further, such a system allows an employee in a difference physical or geographical location to respond to customer requests, as needed.

In a first aspect of the present invention, a contactless call button unit comprises a proximity sensor, such as an ambient light sensor, operatively connected to a microcontroller including a transmitter. The call button can be triggered without the user needing to make direct contact with the call button unit in any way. Instead, when the user's hand or finger is placed in close proximity with the call button unit, the proximity sensor will be triggered. Once the sensor is triggered, the microcontroller can transmit a signal via the transmitter to a receiver in the IoT platform. Such a receiver could be a central hub appliance, which can then route the signal as desired. In the alternative, the receiver could be connected directly with an employee's communication device, such as a phone, tablet, radio or walkie-talkie.

In accordance with embodiments of the present invention, the call button can use a variety of sensing means, including but not limited to capacitance sensing, pyroelectric sensing, reflected light sensing, ultrasonic sensing, or ambient light sensing.

In alternate embodiments, the call button unit can include aural or visual components that can be triggered by the proximity sensor—for example, a light that flashes to indicate that the call button unit has detected the user's presence and sent an alert message; or a digital display screen that provides an update as to the status of a request for assistance; or an intercom permitting the user to communicate with a store employee in touch-free manner. The call button unit can also be adapted to permit a user to interact with a store employee, as necessary, using proximity sensors to allow for communicative purposes. For example, triggering a call button can initiate an interaction on a display or computer screen at the call button location to prompt the customer for further information to assist the customer's needs.

It is a further object of the present invention to provide a facility-wide signaling system comprised of a central hub and a plurality of contactless call buttons that can be activated without the need for physical touch or contact with the user.

These and other objects, features and advantages of the present invention will become apparent in light of the detailed description of embodiments thereof, as illustrated in the accompanying drawings.

DETAILED DESCRIPTION OF THE INVENTION

Figure 1:
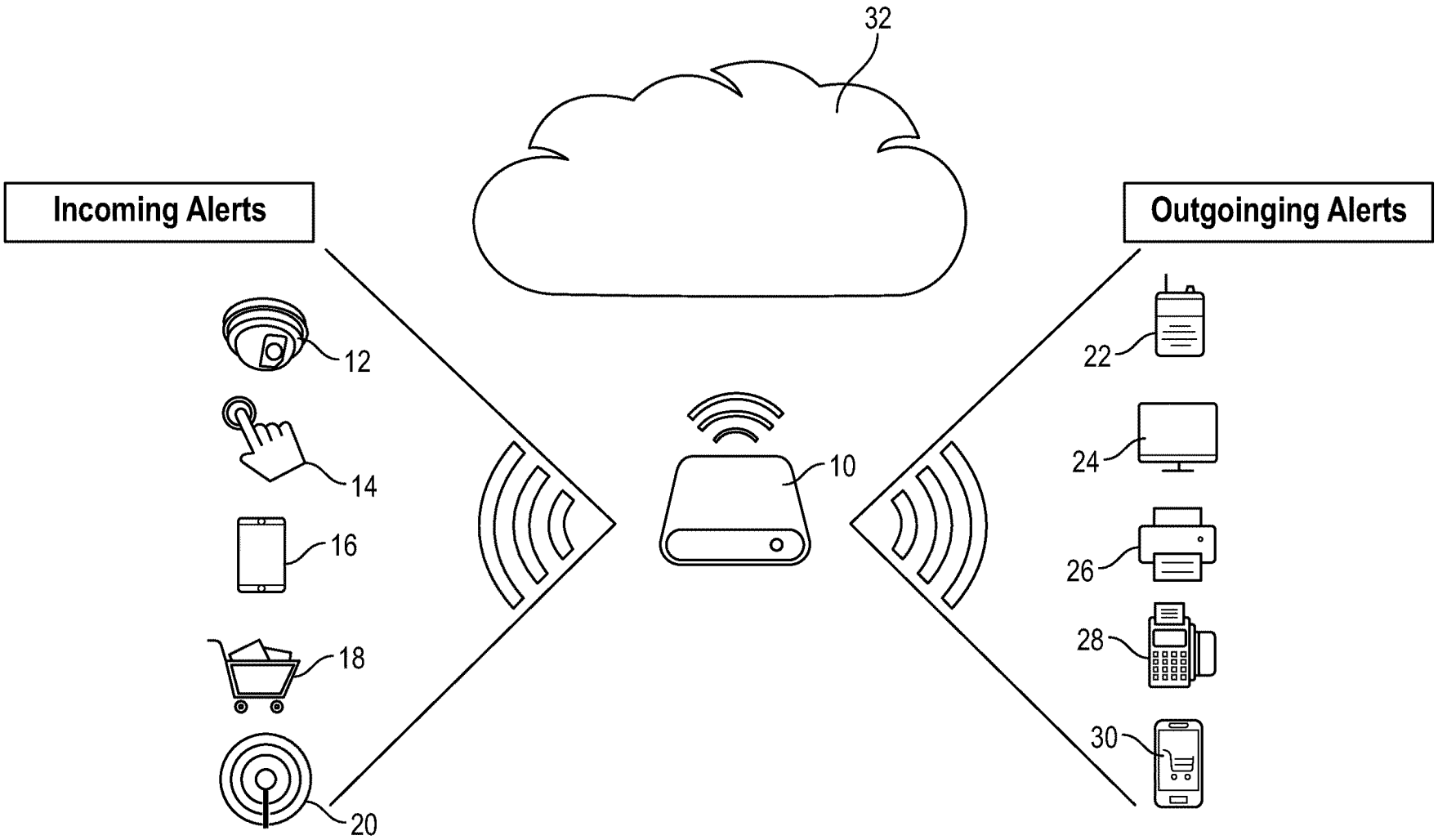
FIG. 1 is a schematic illustrating the interconnectivity of a retail IoT platform in which the present invention can be used and incorporated.
Figure 2:
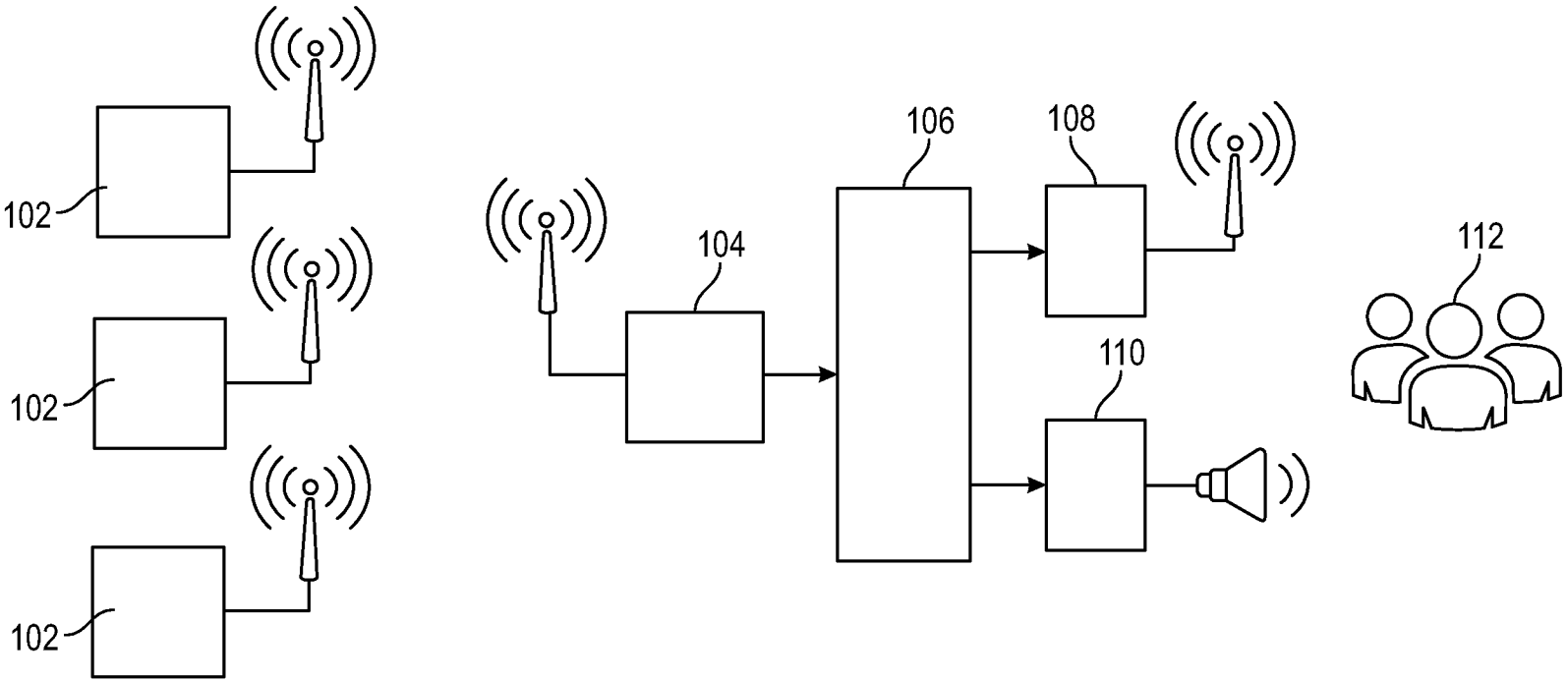
FIG. 2 is a block diagram of a typical facility signaling system.

Referring to FIGS. 1-2, the general overall architecture of a typical retail IoT platform 100 and facility signaling system in accordance with the present invention are illustrated. A plurality of call buttons 102 are preferably distributed throughout a retail space. Each call button 102, when actuated, sends signals, typically digitally-encoded messages carrying the location of the triggered call button 102, to a radio receiver 104, which passes the messages to a central hub appliance 106. As illustrated, communication between call buttons 102 and the radio receiver 104 is preferably through wireless means. In the alternative, call buttons 102 can be hard wired to the central hub appliance 106 without departing from the principles and spirit of the present invention. On receipt of a call button message, the central hub appliance 106 sends an audio message via radio transmitter 108 and/or PA system 110, to personnel, generally designated as reference numeral 112 (for example, via a worker's radio, phone, tablet, computer, walkie-talkie, or other receiver device). Once alerted, a store employee can directly respond to the customer's call request for assistance by going to the location of the triggered call button 102, or by engaging with the customer through aural and/or visual communication means, such as by using an intercom, video conferencing system, or digital display provided at the call button 102. In this regard, the responding employee can either be on-site or remotely located, such as in a call center.

In alternate embodiments of the present invention, the call buttons 102 can be in direct communication with an employee communication receiver device (such as, a worker's radio, phone, tablet, computer, walkie-talkie, or other receiver device) so that a customer's call request can be sent to a designated employee for response. In this regard, individual call buttons 102 can be connected to specifically designated employees, such as, for example, covering different departments of a retail store. Even when requests from the call buttons 102 are routed to employee communication receiver devices in this manner, the signals may also be send to the central hub appliance 106.

Figure 3:
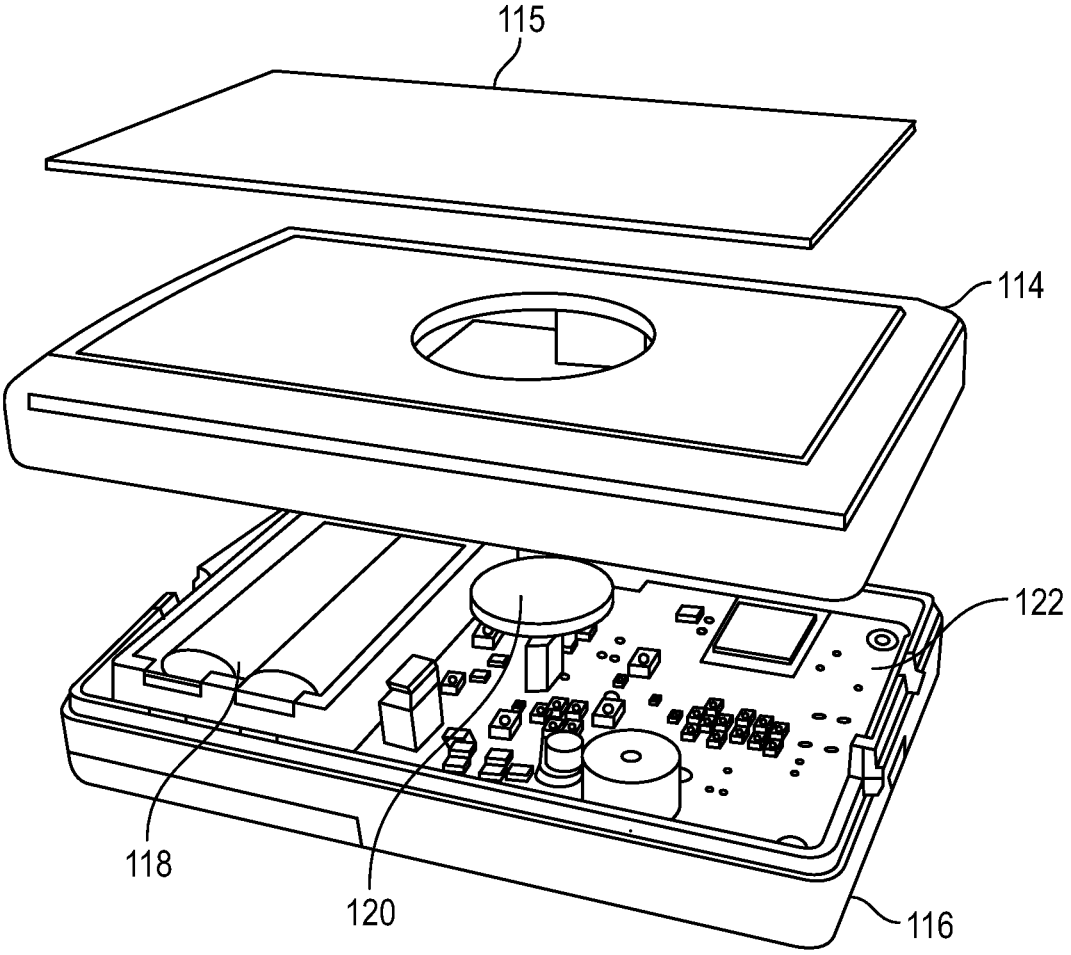
FIG. 3 shows an exploded view of a contactless call button unit in accordance with the present invention.

In accordance with embodiments of the present invention, the call button 102 can be triggered without the user needing to make direct contact with the call button unit 102 in any way. Instead, a "touchless" or "contactless" call button 102 can be triggered without requiring the customer to touch the button 102. An embodiment of a contactless call button unit 102 in accordance with the present invention is illustrated in FIG. 3. As illustrated, the call button unit 102 generally comprises a housing defined by a top enclosure portion 114 and a bottom enclosure portion 116, and a power source 118 (such as batteries) disposed therein in operative communication with a proximity sensor, generally illustrated in FIG. 3 as a capacitive-sensing touch plate 120, and sensing circuitry 122. The capacitive-sensing touch plate 120 is generally aligned with an opening in the top enclosure portion 114 of the housing, and is protected by a graphic overlay 115. The sensing circuitry 122 is in operative communication with the proximity sensor 120 and includes a microcontroller (not shown).

In operation, when a portion of the user's body, typically the user's hand or finger, is placed in close proximity with the call button unit 102, the proximity sensor 120 will be triggered. In accordance with the present invention, the user's hand must be within a predefined distance from the call button unit 102 in order to trigger a call message. Preferably, the user's hand must be in the range of about 1 inch to about 12 inches to trigger the proximity sensor 120, and more preferably between about 1 inch to about 3 inches. Optimally, the call button unit 102 should not be so sensitive as to be easily triggered merely by customers passing by the call button unit 102. In alternate embodiments, the proximity sensor 120 may require the user to be proximal the sensor 120 for a predefined period of time in order to trigger a call message. For example, in preferred embodiments, the user much be positioned by the sensor 120 between about 0 seconds and about 5 seconds in order to trigger the call button 102, and more preferably between about 0 seconds and about 3 seconds, and even more preferably between about 0.5 seconds and about 3 seconds, so that so the sensor is not easily triggered merely by customers or objects passing by the call button unit 102 for a fleeting moment. Once the proximity sensor 120 is triggered, the microcontroller can transmit a signal via a transmitter to a receiver 104 in the IoT platform 100.

FIGS. 4-7 schematically illustrates set-ups of a contactless call button unit 102 in accordance with the present invention using various forms of proximity sensors. Like components in each embodiment uses commonly designated reference numerals.

Figure 4:
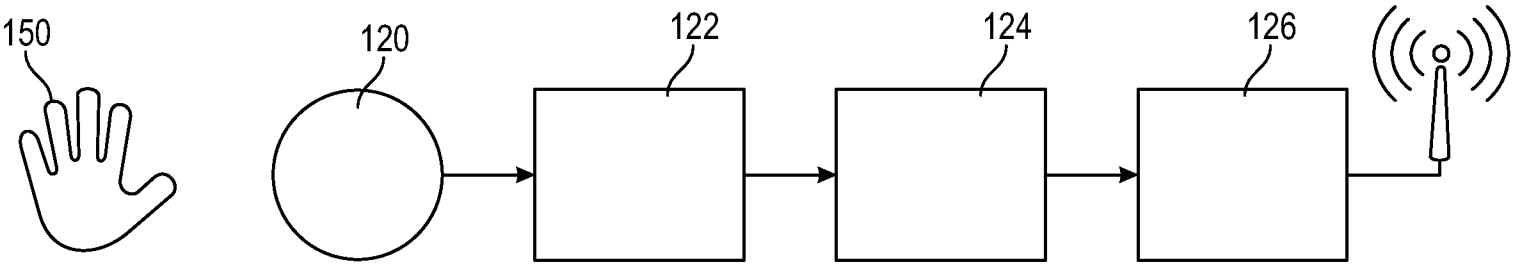
FIG. 4 is a block diagram of a contactless call button using capacitance sensing.

FIG. 4 illustrates the contactless call button 102 of FIG. 3 operating on the principle of capacitance sensing. In operation, the approach of the user's hand 150 relative to the proximity sensor 120 in the form of capacitive-sensing touch plate, connected to a capacitance sensing circuit 122, produces a change in the capacitance sensed by the sensing circuit 122. The change in capacitance is converted to a trigger signal by the sensing circuit 122 and passed to the microcontroller, generally designated as reference numeral 124. Microcontroller 124 composes a message containing the identification and/or location parameters for the triggered call button 102, and transmits the message via radio transmitter 126, for reception by the radio receiver 104 of the central hub appliance 106. Again, as noted above, the call button 102 can be hard wired for sending the call message directly to the hub appliance 106 without departing from the principles and spirit of the present invention.

Figure 5:
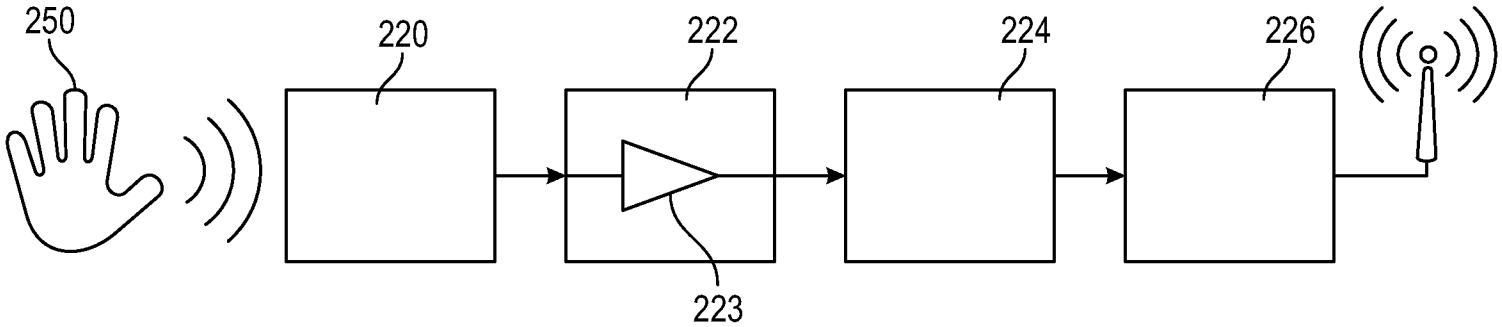
FIG. 5 is a block diagram of a contactless call button using pyroelectric sensing.

FIG. 5 illustrates an alternate embodiment of the present invention, where the contactless call button 102 operates on the principle of passive heat sensing. In operation, the proximity sensor 120 comprises a pyroelectric sensor 220 such that heat energy radiating from the user's hand 250 generates an electrical signal in the pyroelectric sensor 220, which is amplified by an amplifier 223 in the sensing circuitry 222. The amplifier 223 converts the change in sensed heat to a trigger signal which is passed to the microcontroller 224. The microcontroller 224 composes a message containing the identification and/or location parameters of the triggered call button 102, and transmits the message via radio transmitter 226, for reception by the radio receiver 104 of the central hub 106. As the proximity sensor 220 relies on passive heat sensing, it is preferred that the user's hand be within a predefined distance from the call button 102, and also maintain a position relative to the call button 102 for a predefined period of time in order to ensure that the call button 102 is not so sensitive as to be easily triggered merely by customers passing by the call button unit 102. As with other embodiments, the call button 102 can be hard wired for sending the call message directly to the hub appliance 106 without departing from the principles and spirit of the present invention.

Figure 6:
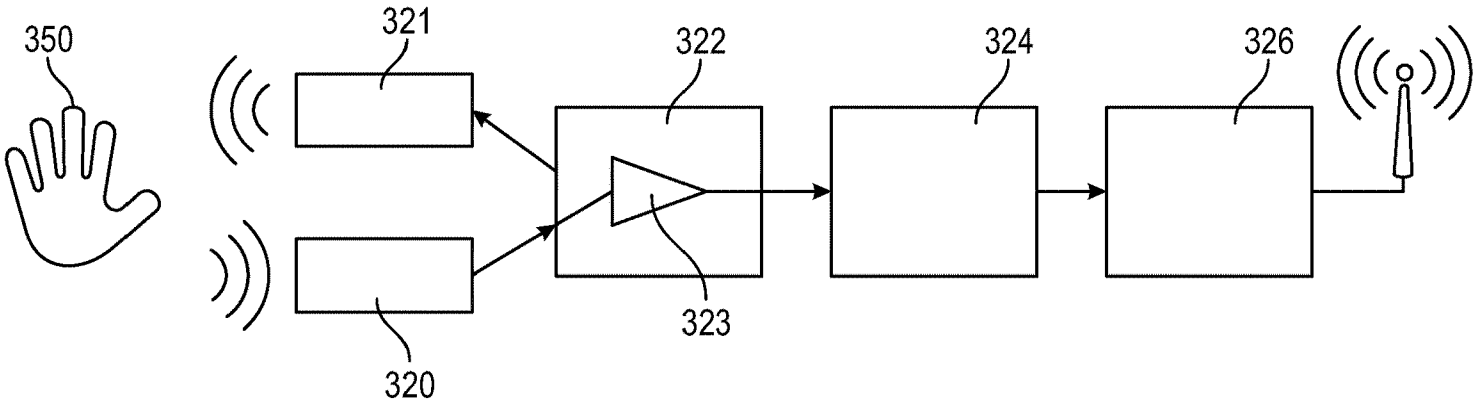
FIG. 6 is a block diagram of a contactless call button using reflected light or ultrasonic sensing.

FIG. 6 illustrates an alternate embodiment of the present invention where the contactless call button 102 operates on the principles of reflected light or reflected sound sensing. In operation, light or sound energy (typically modulated to provide immunity from ambient light or sound) is emitted by an emitter 321. In the case of light energy, infrared is typically used so that no visible light is seen. In the case of sound energy, ultrasonic frequencies are typically used so that no sound is heard. When a user's hand 350 is brought into the proximity of the call button 102, it reflects some of the emitted light or sound into a detector 320. The output of the detector 320 output is amplified in the sensing circuitry 322 by an amplifier 323, which converts the amplified signal into a trigger signal which is passed to a microcontroller 324. The microcontroller 324 composes a message containing the identification and/or location parameters for the triggered call button 102, and transmits the message via radio transmitter 326, for reception by the radio receiver 104 of the central hub 106. As with other embodiments, the call button 102 can be hard wired for sending the call message directly to the hub appliance 106 without departing from the principles and spirit of the present invention.

Figure 7:
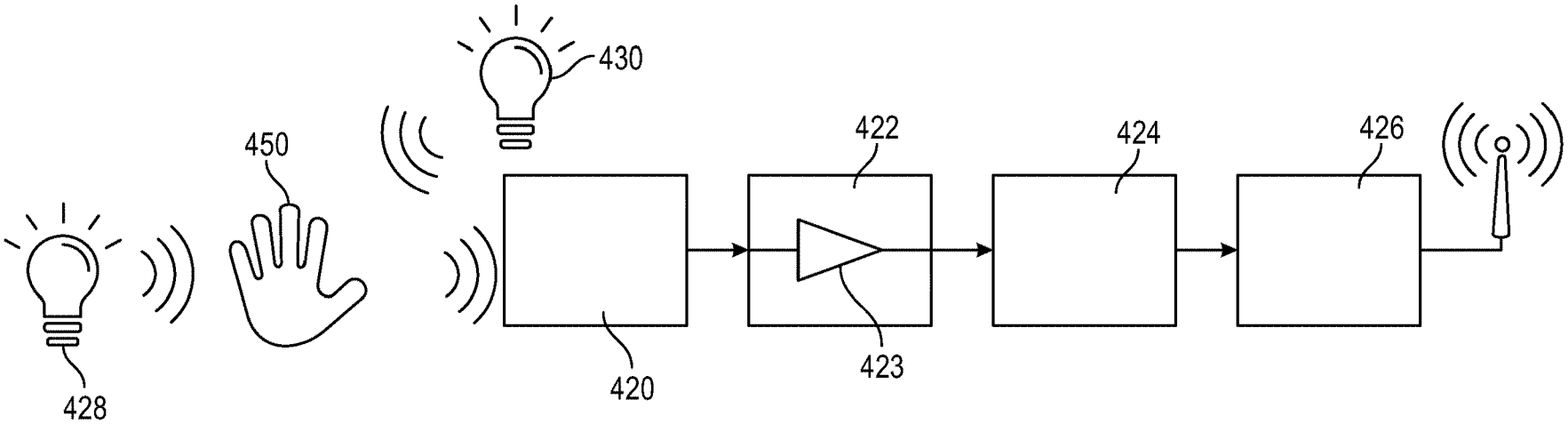
FIG. 7 is a block diagram of a contactless call button using ambient light sensing.

FIG. 7 illustrates an alternate embodiment of the present invention where the contactless call button 102 operates on the principle of ambient light sensing. Ambient light energy is emitted by natural and artificial light sources, represented as bulbs 428 and 430, which can be thought of as being either behind the user's hand 450, or behind ambient light sensor 420, respectively. When a user's hand 450 is brought into the proximity of the call button 102, it occludes the light emitted by light source 428 and reflects light emitted by light source 430. The changes in light reaching light detector 420 are amplified by an amplifier 423 in the sensing circuitry 422, which converts the changes into a trigger signal that is passed to a microcontroller 424. The microcontroller 424 composes a message containing the identification and/or location parameters of the triggered call button 102, and transmits the message via radio transmitter 426, for reception by the radio receiver 104 of the central hub 106. As with other embodiments, the call button 102 can be hard wired for sending the call message directly to the hub appliance 106 without departing from the principles and spirit of the present invention.

The present invention can further comprise a facility-wide signaling system comprised of a central hub appliance 106 and a plurality of contactless call buttons 102 distributed throughout the floorplan of the facility that can be activated without the need for physical touch or contact with the user. The signaling system will be able to discern from which call button 102 the message originated and be able to alert a store employee of where assistance is needed. In alternate embodiments, when a call button 102 is triggered, a line of communication can be created directly between a remotely located store employee, for example, by means of a computer workstation or via a tablet or phone, and a customer whereby the employee can interact aurally and/or visually with the customer through devices associated with the call button unit 102.

Figure 8:
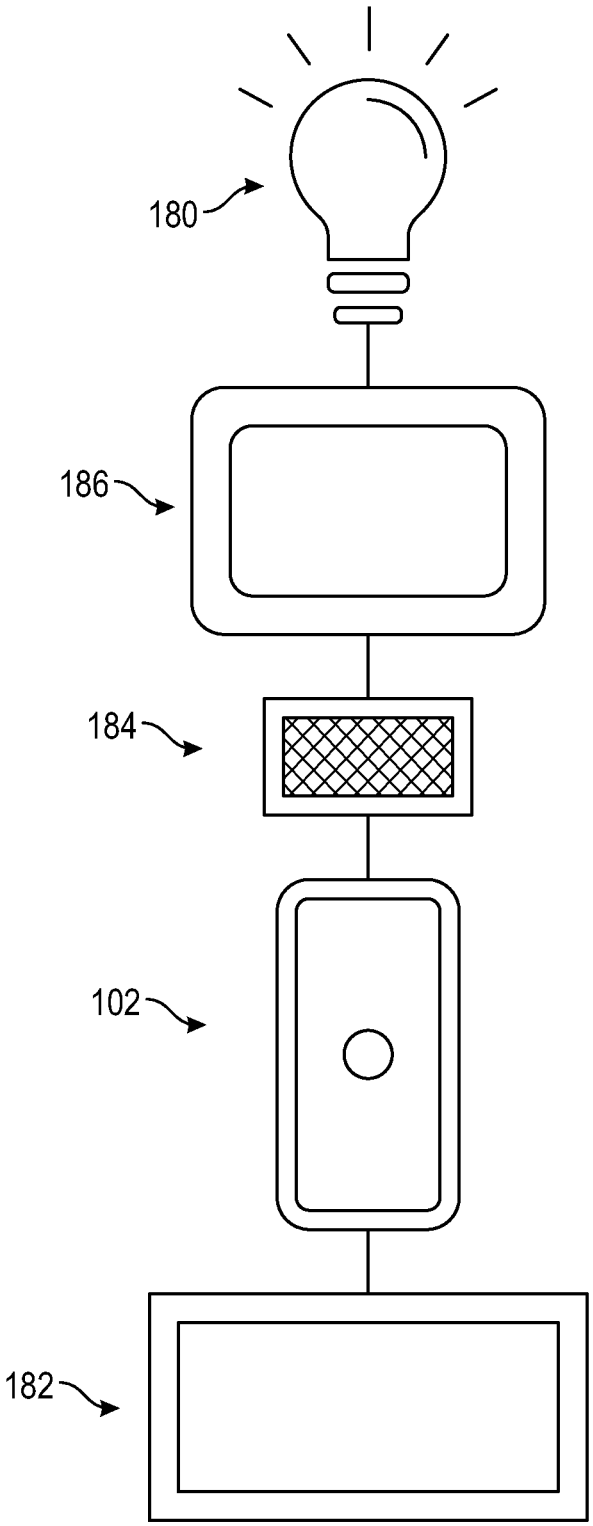
FIG. 8 illustrates a schematic of a contactless call button for use in a retail environment in combination with aural and visual communication components in accordance with the present invention.

In alternate embodiments, the call button unit 102 can include aural or visual components that can be triggered by the proximity sensor such as generally illustrated in FIG. 8. For example, the call button unit 102 can be associated with a signal light 180 that flashes to indicate that the call button unit 102 has detected the user's presence and sent an alert message. An interactive digital display screen 182 may provide an update as to the status of a request for assistance, or provide a means for the customer to provide more detail about the request for assistance. An intercom 184, comprising a speaker and a microphone, and a video conferencing system 186, comprising a camera and a microphone, can permit the user to communicate with a store employee in touch-free manner. The call button unit 102 can also be adapted to permit a user to interact with a store employee, as necessary, using proximity sensors to allow for communicative purposes. Similarly, the call button unit 102 can include or be connected with means for aural and/or visual interaction between customers and workers—for example, via an intercom or digital display set-up. Further, customer use of the call button 102 can activate a corresponding video camera to assist interaction with the customer.

The foregoing description of embodiments of the present invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A contactless client signaling system for use within a retail Internet of Things (IoT) platform, said contactless client signaling system comprising:

a contactless call button unit in operative communication with at least one of a hub appliance and an employee communication receiver for providing an alert signal when said call button unit is engaged, said call button unit comprising a proximity sensor and a transmitter, wherein the alert signal is transmitted by the transmitter when the proximity sensor is triggered, said proximity sensor being triggered when a portion of a user's body is within a predefined distance from the call button unit;

wherein the proximity sensor can be triggered without any direct contact between the user and the call button unit.

2. The contactless client signaling system according to claim 1, wherein the proximity sensor comprises a capacitance sensor.

3. The contactless client signaling system according to claim 1, wherein the proximity sensor comprises a pyroelectric sensor.

4. The contactless client signaling system according to claim 1, wherein the proximity sensor comprises a reflected light sensor.

5. The contactless client signaling system according to claim 1, wherein the proximity sensor comprises an ultrasonic sensor.

6. The contactless client signaling system according to claim 1, wherein the proximity sensor comprises an ambient light sensor.

7. The contactless client signaling system according to claim 1, wherein the predefined distance is between about 1 inch and about 12 inches.

8. The contactless client signaling system according to claim 7, wherein the predefined distance is between about 1 inch and about 3 inches.

9. The contactless client signaling system according to claim 1, wherein the proximity sensor will not be triggered unless a portion of the user's body with within the predefined distance from the call button unit for a predefined period of time.

10. The contactless client signaling system according to claim 1, wherein the call button unit is in operative communication with a communication device that operates when the proximity sensor is triggered.

11. The contactless client signaling system according to claim 10, wherein the communication device comprises at least one of an intercom speaker; an intercom microphone; an interactive digital display; a video conferencing system; and a signal light.

12. A contactless client signaling system for use within a retail Internet of Things (IoT) platform, said contactless client signaling system comprising:

a contactless call button unit in operative communication with at least one of a hub appliance and an employee communication receiver for providing an alert signal when said call button unit is engaged, said call button unit comprising a proximity sensor and a transmitter, wherein the alert signal is transmitted by the transmitter when the proximity sensor is triggered, said proximity sensor being triggered when a portion of a user's body is within a predefined distance from the call button unit; and a communication device located proximate the call button unit that is operable when the proximity sensor is triggered;

wherein the proximity sensor can be triggered without any direct contact between the user and the call button unit; and wherein the proximity sensor will not be triggered unless a portion of the user's body with within the predefined distance from the call button unit for a predefined period of time.

13. The contactless client signaling system according to claim 12, wherein the communication device comprises at least one of an intercom speaker; an intercom microphone; an interactive digital display; a video conferencing system; and a signal light.

14. The contactless client signaling system according to claim 12, wherein the proximity sensor comprises a capacitance sensor.

15. The contactless client signaling system according to claim 12, wherein the proximity sensor comprises a pyroelectric sensor.

16. The contactless client signaling system according to claim 12, wherein the proximity sensor comprises a reflected light sensor.

17. The contactless client signaling system according to claim 12, wherein the proximity sensor comprises an ultrasonic sensor.

18. The contactless client signaling system according to claim 12, wherein the proximity sensor comprises an ambient light sensor.

19. The contactless client signaling system according to claim 12, wherein the predefined distance is between about 1 inch and about 12 inches.

20. The contactless client signaling system according to claim 19, wherein the predefined distance is between about 1 inch and about 3 inches.

* * * * *